US006994656B2

(12) United States Patent
Liao et al.

(10) Patent No.: US 6,994,656 B2
(45) Date of Patent: Feb. 7, 2006

(54) EXERCISE APPARATUS

(75) Inventors: Hung-Mao Liao, Taichung (TW); Fu-An Chen, Chang-Hua Hsien (TW); Chin-Chia Liu, Chang-Hua Hsien (TW)

(73) Assignee: Johnson Tech, Co., Ltd., Taichung Hsien (TW)

( * ) Notice: Subject to any disclaimer, the term of this patent is extended or adjusted under 35 U.S.C. 154(b) by 257 days.

(21) Appl. No.: 10/712,152

(22) Filed: Nov. 13, 2003

(65) Prior Publication Data

US 2004/0097340 A1 May 20, 2004

Related U.S. Application Data

(63) Continuation-in-part of application No. 10/379,514, filed on Mar. 5, 2003, now Pat. No. 6,719,666, and a continuation-in-part of application No. 10/289,727, filed on Nov. 7, 2002, now Pat. No. 6,672,992.

(30) Foreign Application Priority Data

Jun. 20, 2003 (TW) ..... 92211337 U

(51) Int. Cl.
*A63B 69/16* (2006.01)
*A63B 22/04* (2006.01)

(52) U.S. Cl. ..... 482/52; 482/57

(58) Field of Classification Search ..... 482/51–52, 482/57, 70, 79–80
See application file for complete search history.

(56) References Cited

U.S. PATENT DOCUMENTS

| | | | | |
|---|---|---|---|---|
| 5,762,588 | A * | 6/1998 | Chen | 482/57 |
| 5,779,599 | A * | 7/1998 | Chen | 482/57 |
| 5,833,583 | A * | 11/1998 | Chuang | 482/60 |
| 6,672,992 | B1 * | 1/2004 | Lo et al. | 482/52 |
| 6,719,666 | B1 * | 4/2004 | Lo et al. | 482/52 |

* cited by examiner

*Primary Examiner*—Stephen R. Crow
(74) *Attorney, Agent, or Firm*—Trop, Pruner & Hu P.C.

(57) ABSTRACT

An exercise apparatus includes a support frame, a crank assembly, two swing units, and two pedal assemblies. The crank assembly is mounted on the rear of the support frame, and has a crankshaft and a pair of crank members. Each swing unit includes a lever mounted on the front of the support frame, and a longitudinal connecting unit connected to a respective crank member. Each pedal assembly includes a rocking arm with a pivot end mounted pivotally on the front of the support frame, and a pedal axle having a rear end making relative sliding movement with the connecting unit when the pedal axle is moved. The pedal assemblies are respectively connected to the swing units for swinging synchronously with the swing units.

12 Claims, 5 Drawing Sheets

EXERCISE APPARATUS

CROSS-REFERENCE TO RELATED APPLICATION

This application is a continuation-in-part of U.S. patent application Ser. No. 10/289,727 filed on Nov. 7, 2002 now U.S. Pat. No. 6,672,992, and Ser. No. 10/379,514, filed on Mar. 5, 2003 now U.S. Pat. No. 6,719,666, the entire disclosures of which are incorporated herein by reference.

This application claims priority of Taiwanese Application No. 092211337, filed on Jun. 20, 2003.

BACKGROUND OF THE INVENTION

1. Field of the Invention

The invention relates to an exercise apparatus, more particularly to an exercise apparatus that can provide stability during exercise.

2. Description of the Related Art

A conventional exercise apparatus has a pedal assembly fixed on a crank assembly. During exercise, the user moves the pedal assembly and the crank assembly by applying a pedaling action. The pedal assembly rotates about the crank assembly so that the user's feet will travel in a generally elliptical track. However, the elliptical movement produced by the conventional exercise apparatus cannot be adjusted so as to suit exercise requirements and the height of the user.

In order to solve the aforementioned drawbacks, the applicant of this application has suggested improvements in co-pending U.S. patent application Ser. Nos. 10/289,727 and 10/379,514. The improvements involve adjustment of the swinging amplitudes of the pedal assemblies to vary the magnitude of the elliptical path of the pedals. The disclosures of the co-pending applications are hereby incorporated by reference into the specification. However, in order to enhance stability of the exercise apparatus during operation, further improvements are desirable.

SUMMARY OF THE INVENTION

Therefore, the object of the present invention is to provide an exercise apparatus with a stabilizing support for improved stability during operation.

According to one aspect of this invention, an exercise apparatus comprises a support frame, a crank assembly, two swing units, and two pedal assemblies. The support frame includes a base support adapted to be mounted on a support surface and having opposite front and rear portions, and a front support extending upwardly from the front portion. The crank assembly has a crankshaft mounted rotatably on the rear portion, and a pair of crank members mounted respectively on two opposite ends of the crankshaft. Each of the swing units includes a lever mounted pivotally on the front support, and a longitudinal connecting unit connected to a respective one of the crank members and connected to the lever. Each of the pedal assemblies includes a rocking arm, and a pedal axle having a front end connected to the rocking arm and a rear end opposite to the front end. The rocking arms of the pedal assemblies have pivot ends mounted pivotally and respectively on left and right sides of the front support. The pedal axle has the rear end making relative sliding movement with the connecting unit when the pedal axle is moved. The pedal assemblies are respectively connected to the swing units for swinging synchronously with the swing units.

Preferably, the exercise apparatus of this invention further comprises a stabilizing support and a sliding member. The stabilizing support is connected pivotally to the connecting unit, and is adapted to contact and slide on the support surface. The sliding member is connected to one of the rear end of the pedal axle and the connecting unit to slide on the other one of the rear end of the pedal axle and the connecting unit.

According to another aspect of this invention, an exercise apparatus comprises a support frame, a crank assembly, two swing units, two pedal assemblies, and an adjustment unit. The support frame includes a base support adapted to be mounted on a support surface and having opposite front and rear portions, and a front support extending upwardly from the front portion. The crank assembly has a crankshaft mounted rotatably on the rear portion, and a pair of crank members mounted respectively on two opposite ends of the crankshaft. Each of the swing units includes a lever mounted pivotally on the front support, and a longitudinal connecting unit connected to a respective one of the crank members and connected to the lever. Each of the pedal assemblies includes a rocking arm, and a pedal axle having a front end connected to the rocking arm. The rocking arms of the pedal assemblies have pivot ends mounted pivotally and respectively on left and right sides of the front support. The pedal assemblies are respectively connected to the swing units for swinging synchronously with the swing units. The adjustment unit is for adjusting the swinging amplitude of the pedal assemblies. The adjustment unit is mounted movably on the front support to move upwardly and downwardly, and is connected to the pivot ends of the rocking arms of the pedal assemblies.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
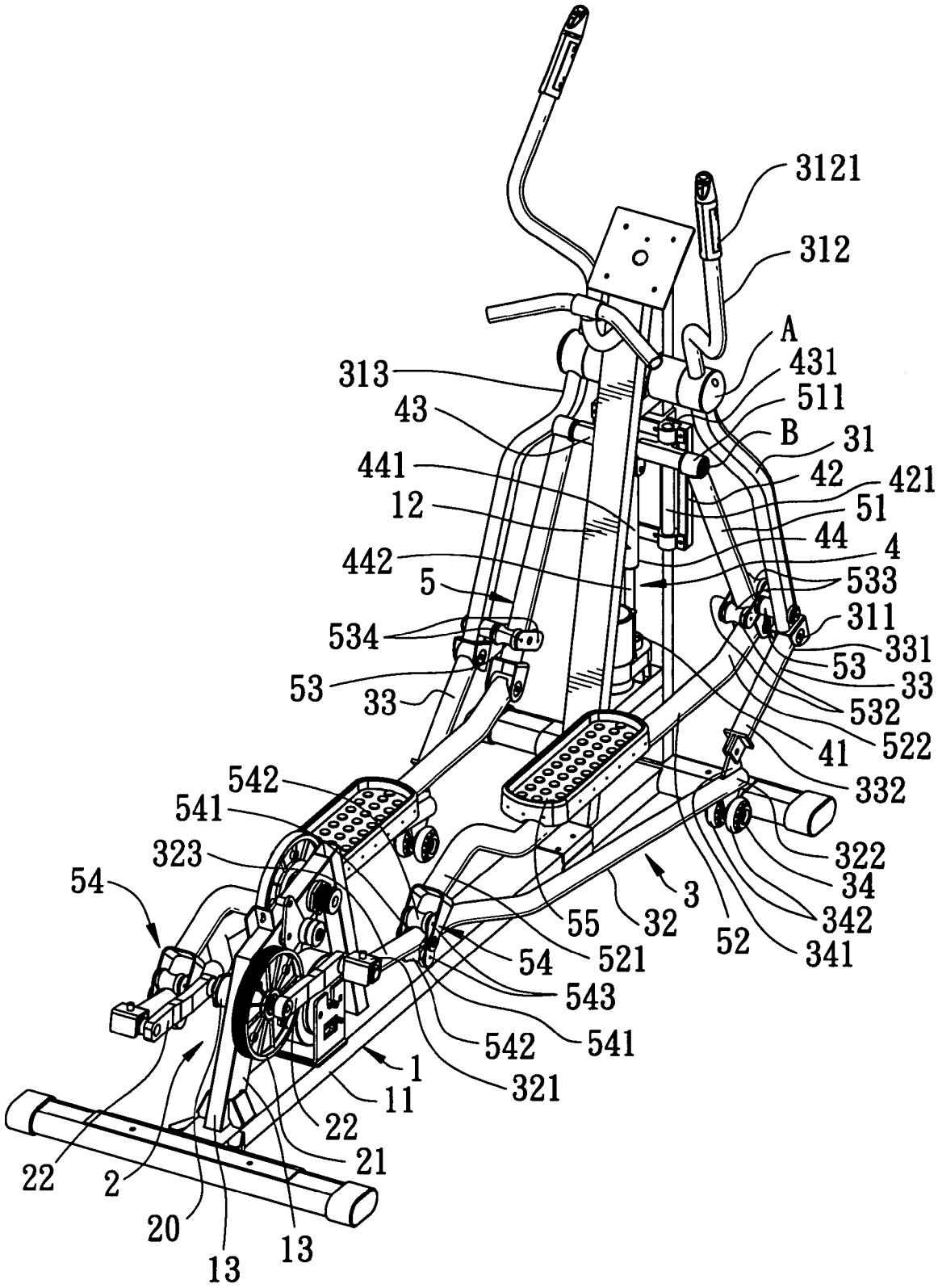
FIG. 1 is a perspective view of the preferred embodiment of the exercise apparatus according to the present invention.

Referring to FIGS. 1 to 5, the preferred embodiment of an exercise apparatus according to this invention is shown to comprise a support frame 1, a crank assembly 2, two swing units 3, an adjustment unit 4, two pedal assemblies 5, and two synchronizing members 53.

The support frame 1 includes a base support 11, a front support 12, and a rear support 13. The base support 11 is adapted to be mounted on a support surface, such as a ground surface, and has front and rear portions opposite to each other in a longitudinal direction. The front support 12 is disposed on and extends upwardly from the front portion of the base support 11. The rear support 13 is disposed on and extends upwardly from the rear portion of the base support 11.

The crank assembly 2 is disposed on the rear support 13, and has a crankshaft 20 mounted rotatably on the rear support 13, a flywheel 21 mounted rotatably on the crankshaft 20, and a pair of crank members 22 mounted respectively on two opposite ends of the crankshaft 20.

Each of the swing units 3 includes a lever 31, a longitudinal connecting unit composed of a connecting rod 32 and a link member 33, and a stabilizing support 34. The lever 31 has a top end 312 provided with a handle 3121, a bottom end 311 opposite to the top end 312, and an intermediate portion 313 between the top and bottom ends 312, 311. The intermediate portions 313 of the levers 31 of the swing units 3 are connected pivotally and respectively to left and right sides of the front support 12 about an axis (A). The connecting rod 32 has a rear end 321 connected pivotally to the respective one of the crank members 22, a front end 322 opposite to the rear end 321, and a linear section 323 proximate to the rear end 321. The link member 33 has a first end 331 connected pivotally to the bottom end 311 of the lever 31, and a second end 332 opposite to the first end 331. The stabilizing support 34 is connected pivotally to the connecting unit to contact and move on the support surface. In this embodiment, the stabilizing support 34 includes a bracket member 341 with a top end connected pivotally to the second end 332 of the respective link member 33. A pair of rollers 342 are attached rotatably to a bottom end of the bracket member 341 at two opposite sides thereof to contact and move on the support surface. The bracket member 341 is secured to the front end 322 of the connecting rod 32 between the top and bottom ends thereof. When the handle 3121 of the lever 31 of the respective swing unit 3 is swung relative to the axis (A), the link member 33 of the respective swing unit 3 pulls the front end 322 of the connecting rod 32 to slide back and forth, and the rollers 342 roll stably on the support surface.

Figure 2:
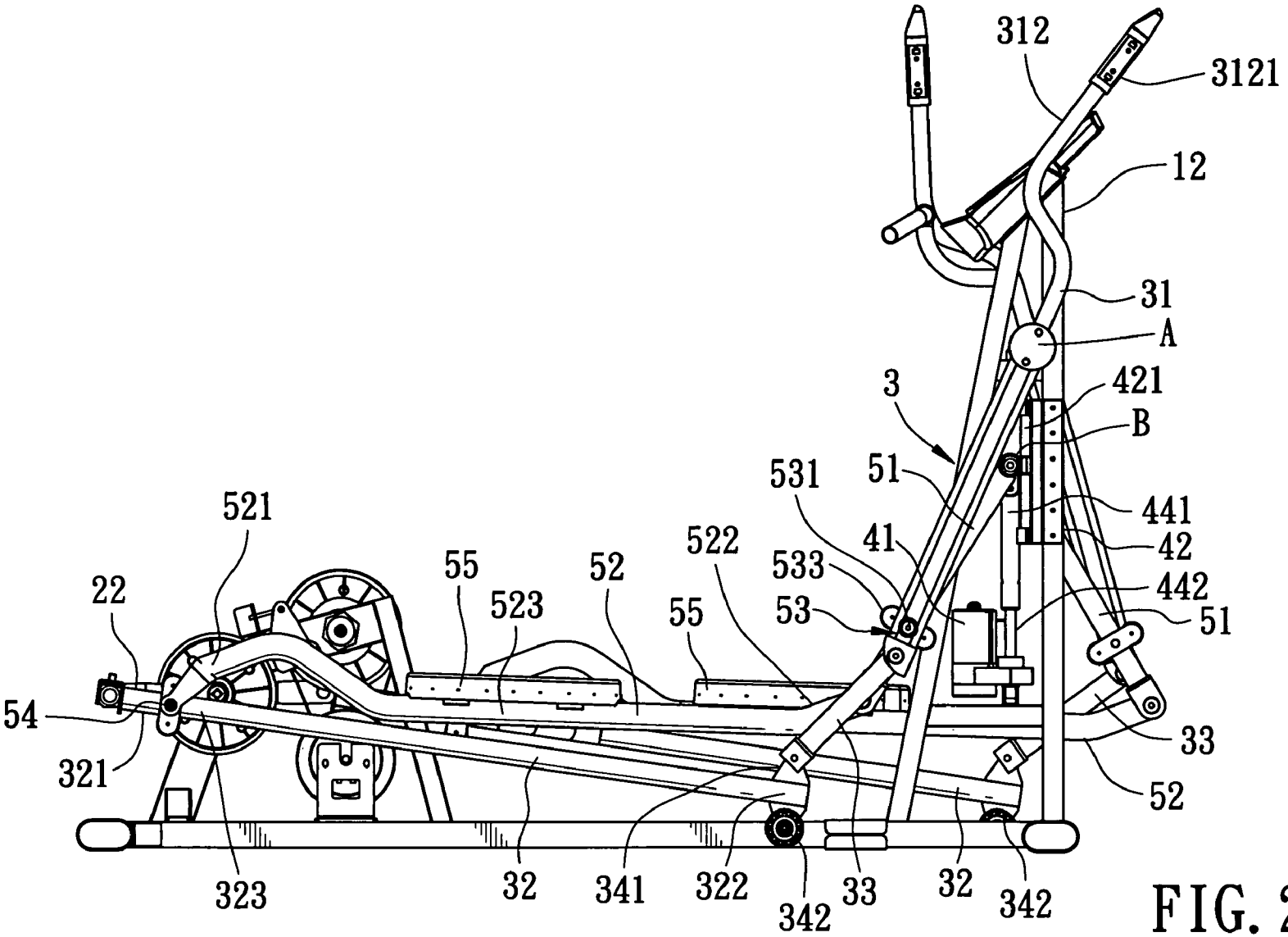
FIG. 2 is a side view of the preferred embodiment, illustrating how a larger elliptical motion can be obtained during exercise.

Each of the pedal assemblies 5 includes a rocking arm 51, a pedal axle 52, a pedal member 55, and a sliding member 54. The rocking arms 51 of the pedal assemblies 5 have pivot ends 511 mounted pivotally and respectively on left and right sides of the front support 12. The pedal axle 52 has a front end 522 connected pivotally to the rocking arm 51, a rear end 521 opposite to the front end 522, and an intermediate portion 523 (see FIG. 2) between the front and rear ends 522, 521 of the pedal axle 52. The pedal members 55 are mounted fixedly and respectively on the intermediate portions 523 of the pedal axles 52. The sliding member 54 is connected to the rear end 521 of the pedal axle 52, and is in slidable contact with the connecting rod 32. As shown in FIGS. 1 and 2, the sliding member 54 includes a pair of spaced-apart seat plates 541, a pair of spaced-apart cross pins 543 extending across the seat plates 541, and a pair of rollers 542 that are mounted respectively on the cross pins 543 and that are disposed between the seat plates 541. The seat plates 541 are secured to the rear end 521 of the pedal axle 52. The linear section 323 of the connecting rod 32 passes between and is in contact with the rollers 541 so that the rear end 521 of the pedal axle 52 is connected slidably to the linear section 323 of the connecting rod 32. As the rear end 521 of the pedal axle 52 moves along the linear section 323, the pedal axle 52 can produce an elliptical motion when the crank member 22 makes a circular motion.

The adjustment unit 4 is mounted movably on the front support 12, and is pivoted to the pivot ends 511 of the rocking arms 51 of the pedal assemblies 5. The adjustment unit 4 includes a motor 41 mounted on the front portion of the base support 11, a telescopic member 44, a positioning frame 42 fixed on the front support 12, a pair of guide rods 421 (only one is visible in FIGS. 1 to 5), and a cross member 43 extending across the guide rods 421. The telescopic member 44 includes a screw rod 442 connected rotatably to the motor 41 in a known manner, and a tubular sleeve 441 connected fixedly to the cross member 43 and disposed around the screw rod 442. The sleeve 441 is driven by the screw rod 442 to move upwardly and downwardly along the length of the front support 12. The guide rods 421 are connected to the positioning frame 42, extend along the length of the front support 12, and are disposed on the left and right sides of the front support 12. The cross member 43 is connected to the sleeve 441, and extends across the guide rods 421. The cross member 43 has two sockets 431 (only one is visible in FIG. 1) sleeved slidably and respectively on the guide rods 421 so that the cross member 43 can move up and down along the guide rods 421. The pivot ends 511 of the rocking arms 51 of the pedal assemblies are pivoted to two ends of the cross member 43 about a pivot axis (B), which is parallel to the axis (A).

Each of the synchronizing members 53 couples the rocking arm 51 of a respective pedal assembly 5 and the lever 31 of the respective swing unit 3 so as to synchronize movement of the rocking arm 51 and the lever 31. Each synchronizing member 53 is fixed to the lever 31 of the respective swing unit 3, and is connected slidably to the rocking arm 51 of the respective pedal assembly 5. As best shown in FIG. 1, each synchronizing member 53 includes a pair of spaced-apart seat plates 532, a pair of spaced-apart cross pins 534 extending across the seat plates 532, a pair of rollers 533 that are mounted respectively on the cross pins 534 and that are disposed between the seat plates 532, and a connecting pin 531 (see FIG. 2) having one end connected to the bottom end 311 of the lever arm 31 of the respective swing unit 3 and the other end connected to one of the seat plates 532. Each pair of the rollers 533 define a receiving space for passage of the rocking arm 51 of the respective pedal assembly 5 therethrough so that each pair of the rollers 533 can move slidably along the length of the rocking arm 51. The synchronizing members 53 are therefore slidable respectively along the rocking arms 51.

Figure 3:
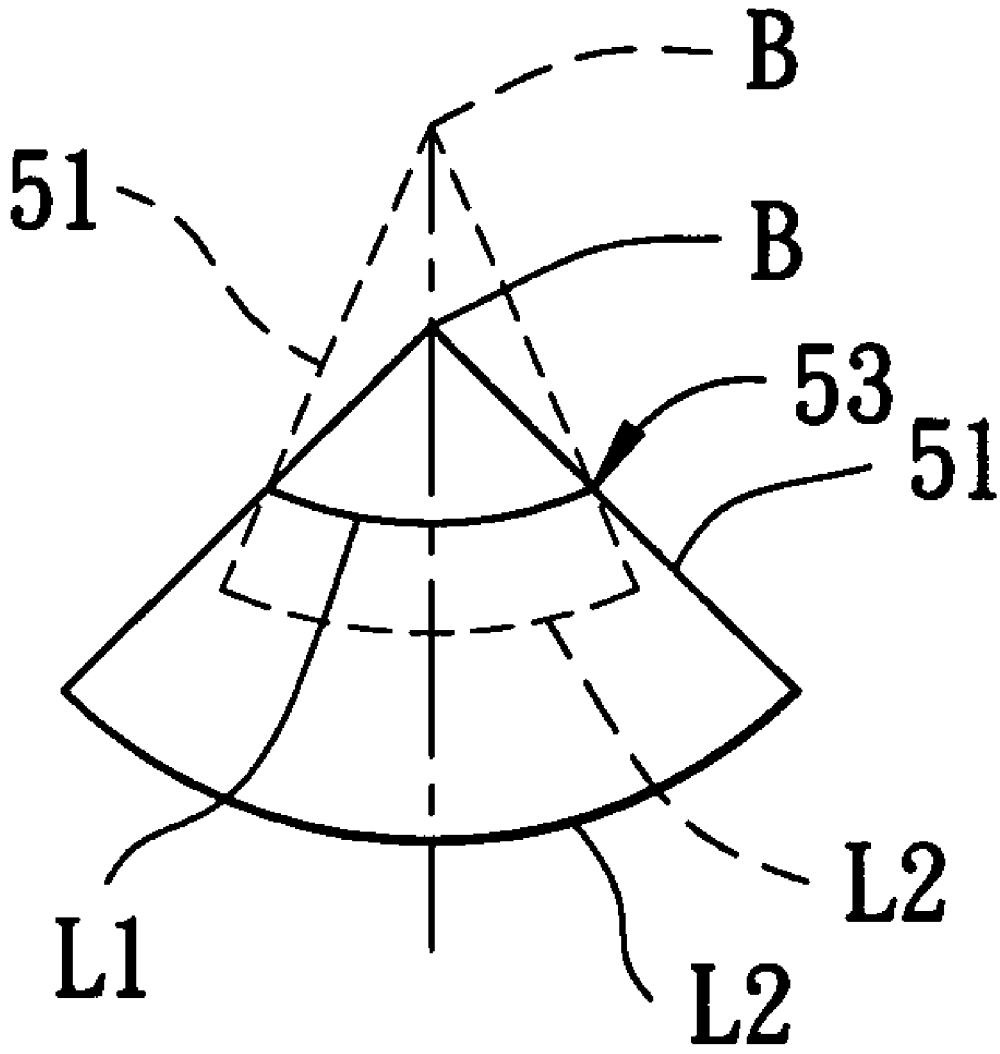
FIG. 3 is a schematic view, illustrating a swinging amplitude of the elliptical motion of FIG. 2.

With reference to FIG. 2, when a larger elliptical motion is desired, the user may actuate the motor 41 to rotate the screw rod 442 so that the sleeve 441 can move downwardly along the screw rod 442 and pull the cross member 43 downwardly along the guide rods 421 of the positioning frame 42. As the cross member 43 slides downwardly along the guide rods 421, the rocking arms 51 move downward through the respective pairs of the rollers 533. As a result, the pivot axis (B) moves toward the synchronizing members 53. Since the levers 31, the connecting rods 32 and the link members 33 are connected to the respective crank members 22, they swing together with a constant swinging amplitude. The synchronizing members 53 also swing with the same constant swinging amplitude. However, the swinging amplitude of the rocking arms 51 is changed when the distance of the synchronizing members 53 from the pivot axis (B) is varied. Suppose the initial swinging amplitude of the synchronizing members 53 is (L1). As shown in FIG. 3, when the pivot axis (B) moves towards the synchronizing members 53, the swinging amplitude of the rocking arms 51 is enlarged to (L2), thereby producing a larger elliptical motion.

When the user stands on the pedal members 55 with his hands grasping the handles 3121 of the levers 31, and starts pedaling forward and rearward, the levers 31 swing about the axis (A) in opposite directions, and the link members 33 of the swing units 3 push the connecting rods 32 of the swing units 3 to slide back and forth along the support surface via the rollers 342 in a constant swinging amplitude. Simultaneously, the rocking arms 51 of the pedal assemblies 5 swing about the pivot axis (B) in synchronized motion with the respective levers 31, and move the pedal axles 52 to swing in larger forward and backward movement. Since the rear ends 321 of the connecting rods 32 of the swing units 3 rotate in circular motions along with the crank members 22, and since the rear ends 521 of the pedal axles 52 move linearly along the linear sections 323 of the respective connecting rods 32, the pedal members 55 move in elliptical motions so that the user can perform an exercise with a larger elliptical motion.

Figure 4:
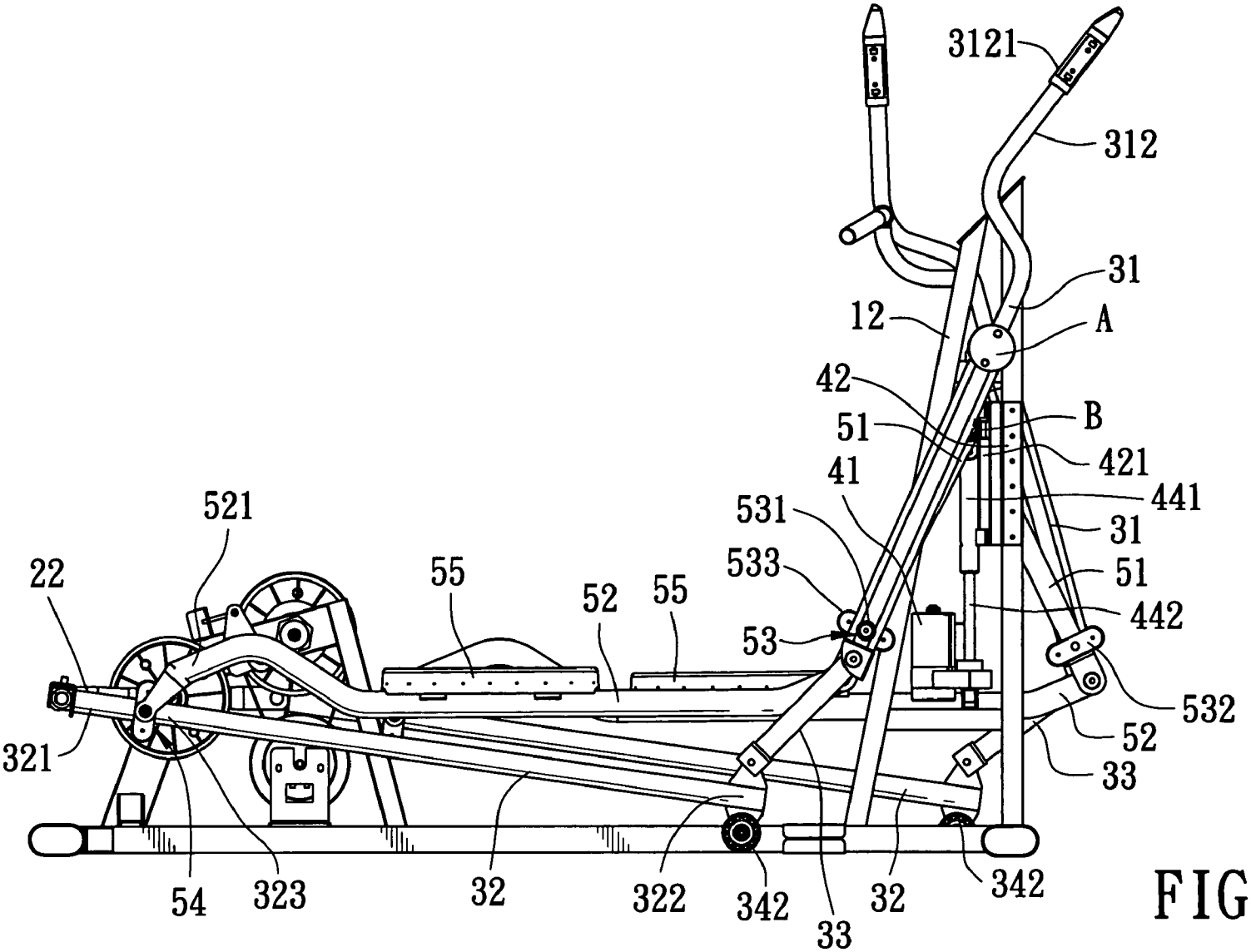
FIG. 4 is a side view of the preferred embodiment, illustrating how a smaller elliptical motion can be obtained during exercise.
Figure 5:
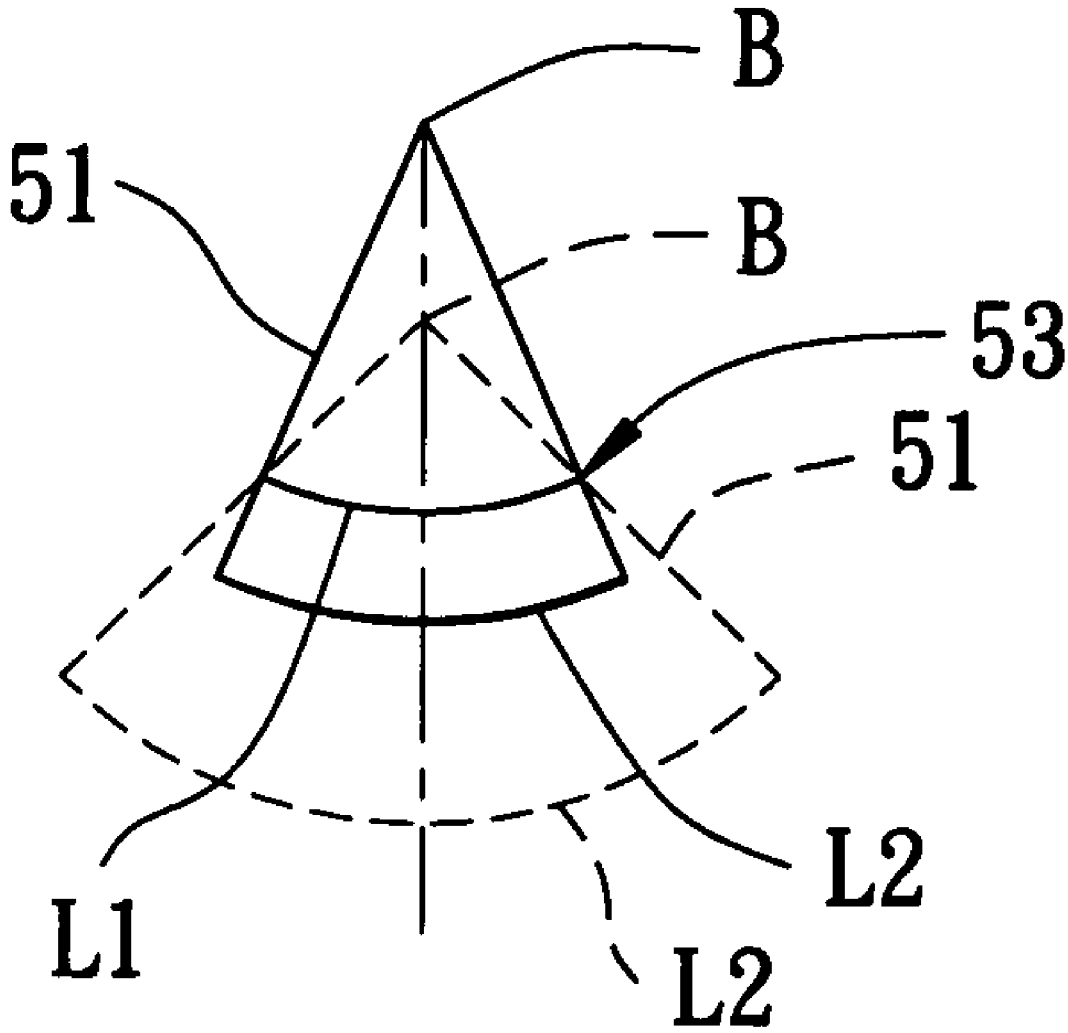
FIG. 5 is a schematic view, illustrating a swinging amplitude of the elliptical motion of FIG. 4.

Referring to FIGS. 4 and 5, when a smaller elliptical motion is desired by the user during exercise, the motor 41 is actuated through an operating panel (not shown) mounted on the front support 12 of the support frame 1 so as to rotate the screw rod 442 so that the sleeve 441 can move upwardly and push the cross member 43 (see FIG. 1) upwardly along the guide rods 421 of the positioning frame 42. The rocking arms 51, at the same time, slide upwardly through the respective pairs of the rollers 533 so that the distance of the pivot axis (B) from the synchronizing members 53 is increased. In other words, the pivot axis (B) moves away from the synchronizing members 53. In this situation, the swinging amplitude (L2) of the rocking arms 51 is reduced, thereby producing a smaller elliptical motion.

The advantages of the exercise apparatus of the present invention can be summarized as follows:

1. The swinging amplitude of the rocking arms 51 of the pedal assemblies 5 can be enlarged or reduced by simply adjusting the distance between the pivot axis (B) and the synchronizing members 53, so that the elliptical path of the pedal members 55 can be enlarged or reduced. As such, the exercise motion can conform to the exercise requirement of the user.

2. Due to the presence of the stabilizing support 34 mounted on the connecting unit of the respective swing units 3, the latter can slide stably on the support surface, thereby stabilizing the exercise apparatus of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An exercise apparatus, comprising:

a support frame including a base support adapted to be mounted on a support surface and having opposite front and rear portions, and a front support extending upwardly from said front portion;

a crank assembly having a crankshaft mounted rotatably on said rear portion, and a pair of crank members mounted respectively on two opposite ends of said crankshaft;

two swing units, each of which includes a lever mounted pivotally on said front support, and a longitudinal connecting unit connected to a respective one of said crank members and connected to said lever; and two pedal assemblies, each of which includes a rocking arm, and a pedal axle having a front end connected to said rocking arm and a rear end opposite to said front end, said rocking arms of said pedal assemblies having pivot ends mounted pivotally and respectively on left and right sides of said front support, said pedal axle having said rear end making relative sliding movement with said connecting unit when said pedal axle is moved, said pedal assemblies being respectively connected to said swing units for swinging synchronously with said swing units.

2. The exercise apparatus as claimed in claim 1, further comprising a stabilizing support that is connected pivotally to said connecting unit and that is adapted to contact and slide on the support surface.

3. The exercise apparatus as claimed in claim 2, wherein said stabilizing support includes a bracket member pivotally connected to said connecting unit, and a roller that is attached to said bracket member and that is adapted to contact and slide on the support surface.

4. The exercise apparatus as claimed in claim 3, wherein said connecting unit of each of said swing units includes a connecting rod connected pivotally to a respective one of said crank members, and a link member connected pivotally to said connecting rod and said lever, said bracket member being attached to one of said link member and said connecting unit.

5. The exercise apparatus as claimed in claim 1, further comprising an adjustment unit for adjusting a swinging amplitude of said pedal assemblies, said adjustment unit being mounted movably on said front support to move upwardly and downwardly and connected to said pivot ends of said rocking arms of said pedal assemblies.

6. The exercise apparatus as claimed in claim 5, further comprising two synchronizing members, each of which couples said rocking arm of a respective one of said pedal assemblies and said lever of a respective one of said swing units.

7. The exercise apparatus as claimed in claim 6, wherein each of said synchronizing members is fixed to the corresponding one of said levers of said swing units, and is connected slidably to the corresponding one of said rocking arms of said pedal assemblies, said rocking arms being slidable with respect to said synchronizing members through said adjustment unit to move said pivot ends of said rocking arms toward or away from said synchronizing members.

8. The exercise apparatus as claimed in claim 1, further comprising a sliding member connected to one of said rear end of said pedal axle and said connecting unit to slide on the other one of said rear end of said pedal axle and said connecting unit.

9. The exercise apparatus as claimed in claim 8, wherein said connecting unit includes a connecting rod connected to the corresponding one of said crank members, said sliding member including at least one roller to slide on said connecting rod.

10. The exercise apparatus as claimed in claim 9, wherein said sliding member includes a pair of spaced-apart seat plates secured to said rear end of said pedal axle, a pair of spaced-apart cross pins extending across said seat plates, and a pair of said rollers that are mounted respectively on said cross pins and that are disposed between said seat plates, said connecting rod passing between and being in contact with said pair of rollers.

11. An exercise apparatus, comprising:

a support frame including a base support adapted to be mounted on a support surface and having opposite front and rear portions, and a front support extending upwardly from said front portion;

a crank assembly having a crankshaft mounted rotatably on said rear portion, and a pair of crank members mounted respectively on two opposite ends of said crankshaft;

two swing units, each of which includes a lever mounted pivotally on said front support, and a longitudinal connecting unit connected to a respective one of said crank members and connected to said lever;

two pedal assemblies, each of which includes a rocking arm, and a pedal axle having a front end connected to said rocking arm, said rocking arms of said pedal assemblies having pivot ends mounted pivotally and respectively on left and right sides of said front support, said pedal assemblies being respectively connected to said swing units for swinging synchronously with said swing units; and an adjustment unit for adjusting the swinging amplitude of said pedal assemblies.

12. The exercise apparatus as claimed in claim 11, wherein said adjustment unit is mounted movably on said front support to move upwardly and downwardly and is connected to said pivot ends of said rocking arms of said pedal assemblies.

* * * * *